US006995341B2

(12) United States Patent
Riefenstein et al.

(10) Patent No.: US 6,995,341 B2
(45) Date of Patent: Feb. 7, 2006

(54) APPARATUS FOR THE HEAT TREATMENT OF SUBSTANCES, IN PARTICULAR FOODS

(75) Inventors: Lutz Riefenstein, Weilheim (DE); Guenther Wurdinger, Peissenberg (DE); Rainer Lammerskitten, Eglfing (DE)

(73) Assignee: Convotherm Elecktrogeraete GmbH, Eglfing (DE)

( * ) Notice: Subject to any disclaimer, the term of this patent is extended or adjusted under 35 U.S.C. 154(b) by 84 days.

(21) Appl. No.: 10/861,824

(22) Filed: Jun. 4, 2004

(65) Prior Publication Data

US 2004/0256374 A1 Dec. 23, 2004

(30) Foreign Application Priority Data

Jun. 17, 2003 (DE) ..... 103 27 282

(51) Int. Cl.
*A21B 1/24* (2006.01)
*A47J 36/38* (2006.01)

(52) U.S. Cl. ..... 219/401; 126/20

(58) Field of Classification Search ..... 219/401; 126/20, 20.1, 20.2

See application file for complete search history.

(56) References Cited

U.S. PATENT DOCUMENTS 4,924,072 A * 5/1990 Oslin ..... 219/401
5,517,980 A * 5/1996 Cappello et al. ..... 126/20
6,555,791 B2 * 4/2003 Lubrina et al. ..... 219/401

FOREIGN PATENT DOCUMENTS

DE 38 21 205 A1 12/1989
DE 196 49 452 A1 6/1998
DE 101 57 808 A1 6/2003
DE 101 62 953 A1 7/2003

* cited by examiner

*Primary Examiner*—Joseph Pelham
(74) *Attorney, Agent, or Firm*—Ohlandt, Greeley, Ruggiero & Perle, L.L.P.

(57) ABSTRACT

The apparatus for the treatment of substances, in particular foods, has a condensation device which is constructed within the cooking chamber (2) and comprises an injector nozzle (16) and a condensation chamber (23) which is constructed as a recess (12) in the cooking chamber bottom. The injector nozzle (16) is further situated within the pressure region (13) of a circulation fan (5). The recess (12) which acts as condensation chamber leaves from the pressure region (13) of the circulation fan (4) and extends into the cooking chamber (2).

10 Claims, 2 Drawing Sheets

APPARATUS FOR THE HEAT TREATMENT OF SUBSTANCES, IN PARTICULAR FOODS

Figure 1:
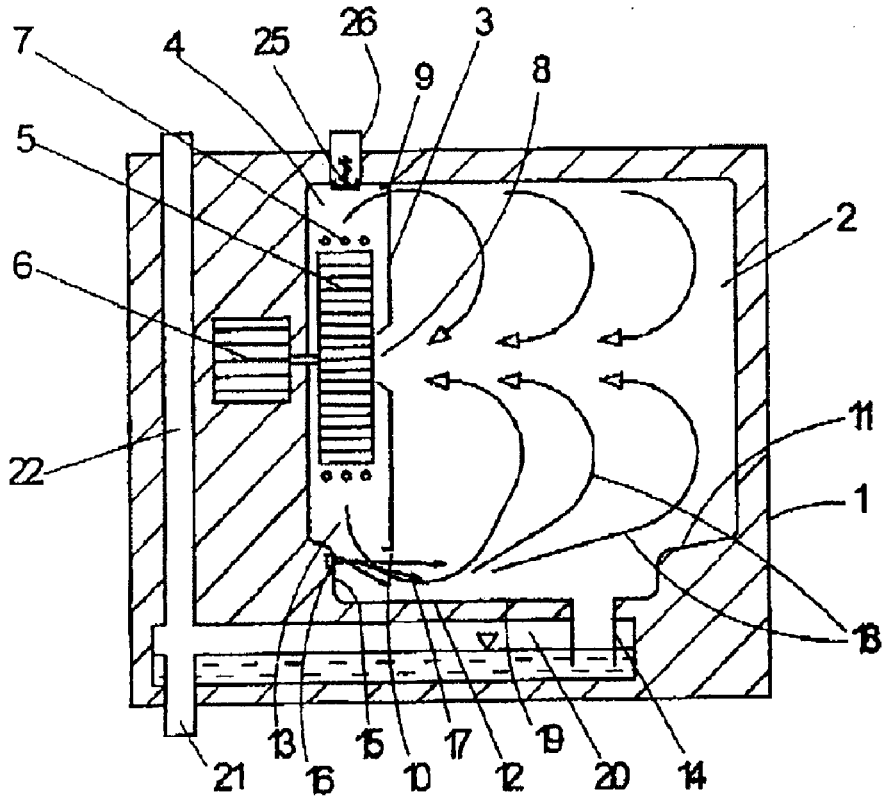

The invention relates to an apparatus for the heat treatment of substances, in particular foods, having a cooking chamber surrounded by a housing, a fan chamber which is separated from the cooking chamber by a separation sheet, but is flow-connected to it via gap throughways and has a circulation fan, a device for generating a vaporous treatment medium in the cooking chamber, a condensation device for condensing excess vapour and having shut-off devices in all lines leading from the cooking chamber to the outside.

An apparatus of this type is disclosed by DE 196 49 452 A1.

In this known apparatus, the mixed condensation takes place outside the cooking apparatus in a pipe system enclosing the cooking apparatus, which is not only an additional construction expense, but also is accompanied by influence on the mixed condensation, since this pipe system starts from the apparatus outlet. This restricts the inflow of the steam to be condensed into the apparatus outlet owing to its relatively small cross section, so that in the event of a relatively large volume of vapour to be precipitated, a relatively long period is required. In the event of excess underpressure in the cooking chamber, the ventilation is performed via the steam generator, the level of which determines the height of the underpressure. A disadvantage with this solution is the fact that in the event of ventilation, water is entrained, which leads to additional evaporation in the cooking chamber, which in some circumstances is not wanted.

It is an object of the invention to design an apparatus of the type described at the outset in such a manner that condensation of large amounts of vapour a rapid recirculation of the air thus dried is made possible without disturbing the mixed condensation via the apparatus outlet.

This object is achieved according to the invention in an apparatus of the type specified in the preamble of claim 1 by means of the fact that the condensation device is constructed as a mixed-condensation device starting from the pressure region of the circulation fan extending into the cooking chamber.

Since the entry into the mixed-condensation device starts from the pressure region of the fan and is not situated in the cooking chamber outlet, a larger cross section for entry of the vapours to be condensed can be provided. Furthermore, the vapour-air mixture is conveyed to an increased extent by the fan into the mixed-condensation device. By these measures it is possible to condense large amounts of vapour in a short time and remove it in the form of condensate from the cooking chamber. Since the mixed-condensation device extends into the cooking chamber and is in direct connection with this, the air dried in this condensation operation passes directly into the cooking chamber. Additional lines which increase the space requirement and also increase the construction expense are not necessary in this case. These lines only cause a pressure drop and a delay of the transfer of the dried air into the cooking chamber. Since the inventive design makes possible an outlet of the condensate separate from the apparatus outlet, and in particular makes possible a separate outlet from a possible additional fat outlet, interferences in the removal of the condensate due to fat deposits can be avoided.

An advantageous development of the invention is that for the mixed condensation, at least one injector nozzle is provided which is situated in the immediate pressure region of the circulation fan and the jet direction of which is essentially directed in the flow direction of the treatment medium. Since the injector nozzle or the injector nozzles provided for water injection are situated in the immediate pressure region of the circulation fan, the vapour-air mixture from which the vapour content is to be condensed out is brought into intimate connection with the ejected water owing to the pressure action of the circulation fan. The immediate closeness of this injector nozzle to the circulation fan is extremely advantageous for the mixing operation between vapour and injected water.

If, in a further advantageous embodiment of the invention, the injector nozzle or injector nozzles is or are disposed on the fan chamber wall opposite the gap throughway of the separation sheet, with spray direction onto the gap at the lower end of the separation sheet, a sufficient mixing chamber is created in which the condensation can take place, so that after passage of the gaseous mixture below the separation sheet, air which is already dried and freed from vapour is present which can then enter directly into the cooking chamber, this operation then continuing in the condensation device open at the top toward the cooking chamber.

An advantageous constructional embodiment is given according to the invention by the fact that the cooking chamber bottom, in the region of the injector nozzle or injector nozzles , has a channel-like recess starting from the pressure region of the fan chamber and reaching into the cooking chamber, the bottom of which recess is inclined in the direction towards the cooking chamber, and in that the injector nozzle or injector nozzles is or are disposed at the end of the channel-like recess assigned to the pressure region of the circulation fan. This channel-like recess can be of width and depth corresponding to requirements, in order to create a sufficient condensation chamber, as a result of which additional lines outside are avoided.

An advantageous development of the invention provides that the width of the recess corresponds to about 20 to 25% of the width of the unit bottom.

If a relatively long condensation chamber and, in conjunction, relatively long spray jets, are required to condense the amount of vapour arising, to increase this condensation chamber, the recess, starting from the separation sheet, can be covered over a part of its length, can be covered by a splash guard. This splash guard, in a development of the invention, can be perforated by orifices so that the air dried by the condensation can enter into the cooking chamber even before the end of this splash guard.

Depending on what substances are treated in the cooking chamber, it can be advantageous if a unit outflow is provided at the lowest point of the recess. This embodiment is suitable when a low fat production is expected. If, in contrast, relatively large amounts of fat arise, it is advantageous that a separate outflow is provided for the water from the mixed condensation.

If, in a further advantageous embodiment of the invention, the cooking chamber ha s an inlet line for ambient air, which inlet line is monitored by an underpressure valve, a flow of ambient air into the cooking chamber when an underpressure is for med via vapour condensation is achieved. This ensures that only the amount of vapour taken off for moisture removal is replaced by fresh ambient air. The inventive restriction of the ambient air fed, corresponding to the decrease in volume of the vapour, achieves the fact that only the absolutely necessary vapour replacement takes place, so that only the fresh air fed which is absolutely necessary need be heated, which favourably influences the energy balance. The underpressure valve used can be a simple cheap sprung underpressure valve.

Figure 2:
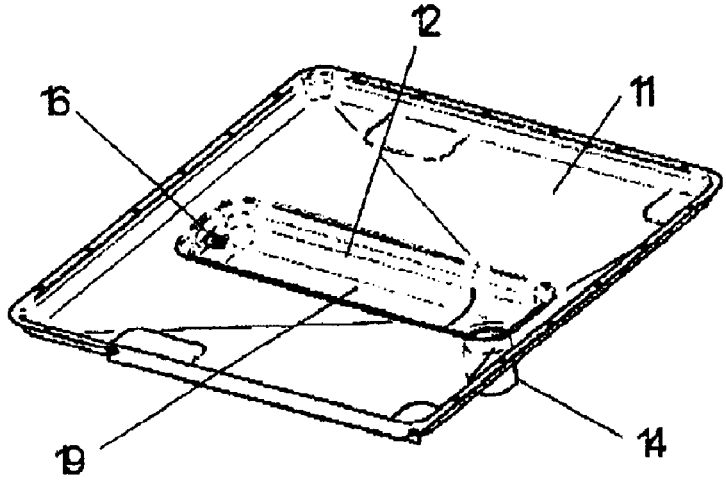
Figure 3:
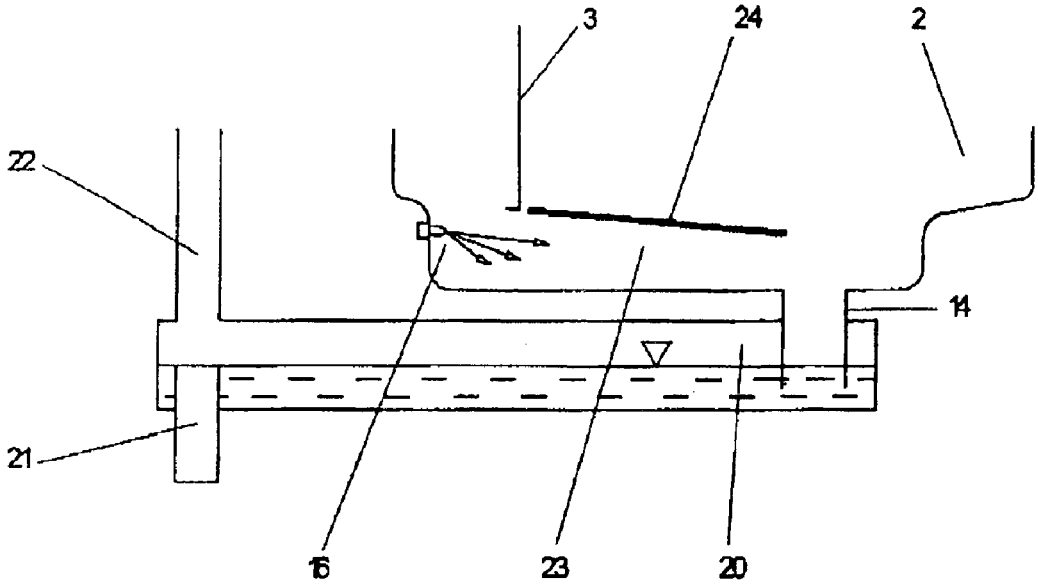

The invention will be described in more detail hereinafter with reference to an exemplary embodiment. In the drawings:

FIG. 1: shows a section through an apparatus for the treatment of foods;

FIG. 2: shows a diagrammatical representation of a unit bottom of the apparatus according to FIG. 1;

FIG. 3: shows an enlarged detail of the sectional representation according to FIG. 1 in the lower region of the apparatus.

Within a housing 1 of an apparatus for the heat treatment of substances, in particular foods, which is also termed cooking unit, a cooking chamber 2 is provided in which these substances are accommodated for treatment. A separation sheet 3 separates off a fan chamber 4 in which a circulation fan 5 is provided which can be driven by a motor 6. The circulation fan is surrounded by a heater 7 which serves for heating the treatment medium which is drawn from the cooking chamber into the fan chamber via a central orifice 8. The separation sheet 3, in addition to lateral slots on its upper and lower rim, which are not shown, has gap throughways 9 and 10 via which the treatment medium after being heated up by the heater 7 can be conveyed back into the cooking chamber 2. As can be seen from FIG. 2, in the housing bottom 11 a channel-like recess 12 is provided which, starting from the pressure region 13 of the fan chamber 4, extends into the cooking chamber, being inclined towards the cooking chamber. At the lowest point of this channel-like recess, a unit outflow 14 is provided. At the end 15 of the channel-like recess 12 which is opposite the gap throughway 10, an injector nozzle 16 is disposed which sprays cold water into the channel-like recess 12 in the direction of the arrows 17, more precisely essentially co-currently with the treatment-medium flow indicated by the arrows 18. The water produced in this mixed condensation runs at the end of the channel-like recess 12 on its bottom 19 to the unit outflow 14 which opens into a siphon 20, the outflow tube of which is designated 21. 22 designates an air vent pipe.

As can be seen from FIG. 3, the chamber within the recess 12 is termed a condensation trough with the designation sign 23 which can be covered by a splash guard 24 in the form of a sheet. This splash guard can also be provided with orifices so that the air freed from vapour in the condensation can escape into the cooking chamber 2 in this region. To permit ambient air to flow into the cooking chamber 2 when an underpressure occurs in this owing to an action of condensation, in the upper region of the cooking chamber an inlet line 26 monitored by an underpressure valve 25 is provided.

What is claimed is:

1. Apparatus for the heat treatment of substances, in particular foods, having a cooking chamber (2) surrounded by a housing (1), a fan chamber (4) which is separated from the cooking chamber (2) by a separation sheet (3) but is flow-connected to it and has a circulation fan (5), a device for generating a vaporous treatment medium in the cooking chamber (2), a condensation device (16) for condensing excess vapour and having shut-off devices (20) in all lines leading from the cooking chamber (2) to the outside, characterized in that the condensation device (16, 23) is constructed as a mixed-condensation device starting from the pressure region (13) of the circulation fan (5) extending into the cooking chamber (2).

2. Apparatus according to claim 1, characterized in that, for the mixed condensation, at least one injector nozzle (16) is provided which is situated in the immediate pressure region (13) of the circulation fan (5) and the jet direction (17) of which is essentially directed in the flow direction (18) of the treatment medium.

3. Apparatus according to claim 2, characterized in that, the injector nozzle (16) or injector nozzles is or are disposed on the fan chamber (13) wall (15) opposite the gap throughway (10) of the separation sheet (3), with spray direction (17) onto the gap throughway (10) at the bottom end of the separation sheet (3).

4. Apparatus according to claim 3, characterized in that the cooking chamber bottom (11), in the region of the injector nozzle (16) or injector nozzles, has a channel-like recess (12) starting from the pressure region (13) of the fan chamber (4) and reaching into the cooking chamber (2), the bottom (19) of which is inclined in the direction towards the cooking chamber, and in that the injector nozzle (16) or injector nozzles is or are disposed at the end (15) of the channel-like recess (12) assigned to the pressure region (13) of the circulation fan (5).

5. Apparatus according to claim 4, characterized in that the width of the recess (12) corresponds to about 20 to 25% of the width of the unit bottom.

6. Apparatus according to claim 4, characterized in that the recess (12), starting from the separation sheet (3) is covered over a part of its length by a splash guard (24).

7. Apparatus according to claim 6, characterized in that the splash guard (24) is perforated by orifices.

8. Apparatus according to claim 4, characterized in that a unit outflow (14) is provided at the lowest point of the recess (12).

9. Apparatus according to claim 4, characterized in that a separate outflow is provided for the water from the mixed condensation.

10. Apparatus according to claim 1, characterized in that the cooking chamber (2) has an inlet line (26) for ambient air, which inlet line is monitored by an underpressure valve (25).

* * * * *